US010386164B2

(12) United States Patent
Polovnev

(10) Patent No.: US 10,386,164 B2
(45) Date of Patent: Aug. 20, 2019

(54) PROJECTILE OF SMALL ARMS AMMUNITION

(71) Applicant: Andrey Albertovich Polovnev, Moscow (RU)

(72) Inventor: Andrey Albertovich Polovnev, Moscow (RU)

(73) Assignee: DSG Technology AS, Horton (NO)

( * ) Notice: Subject to any disclaimer, the term of this patent is extended or adjusted under 35 U.S.C. 154(b) by 106 days.

(21) Appl. No.: 15/502,575

(22) PCT Filed: Aug. 26, 2015

(86) PCT No.: PCT/RU2015/000539
§ 371 (c)(1),
(2) Date: Feb. 8, 2017

(87) PCT Pub. No.: WO2016/032370
PCT Pub. Date: Mar. 3, 2016

(65) Prior Publication Data

US 2018/0306562 A1 Oct. 25, 2018

(30) Foreign Application Priority Data

Aug. 26, 2014 (RU) ..... 2014134718

(51) Int. Cl.
*F42B 10/44* (2006.01)
*F42B 10/46* (2006.01)
*F42B 14/02* (2006.01)

(52) U.S. Cl.
CPC ..... *F42B 10/44* (2013.01); *F42B 10/46* (2013.01); *F42B 14/02* (2013.01)

(58) Field of Classification Search
CPC ..... F42B 10/44; F42B 10/46; F42B 14/02
(Continued)

(56) References Cited

U.S. PATENT DOCUMENTS 1,669,969 A * 5/1928 Caruth ..... F42B 5/025
102/439
1,944,885 A * 1/1934 Gerlich ..... F41A 21/16
102/514
(Continued)

FOREIGN PATENT DOCUMENTS

EP 3187817 A2 * 7/2017 ..... F42B 10/44
RU 2112206 C1 5/1998
(Continued)

OTHER PUBLICATIONS

орбачевский E.; PCT/RU2015/000539; International Search Report and Written Opinion with English Translation of Search Report; ISA/RU; 8 pages; dated Feb. 25, 2016.

*Primary Examiner* — Samir Abdosh
(74) *Attorney, Agent, or Firm* — Nexsen Pruet, LLC; John B. Hardaway, III; Todd A. Serbin

(57) ABSTRACT

The invention relates to small arms ammunition and can be used in the designs of projectiles intended for high precision long-range firing at supersonic and subsonic muzzle velocities of a projectile.

A projectile of small arms ammunition comprises a head portion with a blunted nose surface, a central leading portion, and a boattail, which tapers towards the projectile base, wherein the largest diameter of the cross-section of the central leading portion is equal to "D", the length of the head portion is equal to 1.9-2.9D, and the diameter at the interface between the nose surface and the lateral surface of the head portion is equal to 0.15-0.3D. The lateral surface of the head portion is limited by the surface of two adjoining truncated cones, namely a front cone and a rear cone with opening angles equal to 22-30 degrees and 8-16 degrees respectively, wherein the smaller base of the front truncated cone abuts the nose surface, and the larger base of the rear truncated cone abuts the surface of the central leading portion.
(Continued)

Between the central leading portion and the boattail a step transition is made so that the largest diameter of the cross-section of the boattail is equal to 0.94-0.97D and is less than the diameter of the barrel bore measured at the rifling lands. The invention provides an increase in the ballistic characteristics of projectiles on the trajectory and a decrease in projectiles dispersion.

18 Claims, 2 Drawing Sheets

(58) Field of Classification Search
USPC ..... 102/439
See application file for complete search history.

(56) References Cited

U.S. PATENT DOCUMENTS 2,057,953 A * 10/1936 Joyce ..... F42B 14/02 102/373
2,507,878 A * 5/1950 Banning, Jr. ..... F41A 1/00 102/517
3,154,016 A * 10/1964 Frey ..... F42B 14/02 102/501
4,517,897 A * 5/1985 Kneubuhl ..... B21K 1/025 102/439
4,674,706 A * 6/1987 Hall ..... F42B 10/44 102/489
5,092,246 A * 3/1992 Huerta ..... F42B 12/08 102/439
5,767,438 A * 6/1998 Lang ..... F42B 5/025 102/439
5,798,478 A * 8/1998 Beal ..... F42B 10/44 102/490
6,123,289 A * 9/2000 Manole ..... F42B 8/12 102/386
7,455,015 B2 * 11/2008 Krstic ..... F42B 12/74 102/439
9,719,762 B2 * 8/2017 Langenbeck ..... F42B 5/025
2002/0190155 A1 12/2002 Lipeles et al.
2003/0005846 A1 * 1/2003 Atwood ..... F42B 5/067 102/439
2013/0180424 A1 * 7/2013 Kim ..... F42B 10/44 102/501
2015/0226531 A1 * 8/2015 Silvers ..... F42B 5/28 102/439
2017/0322002 A1 * 11/2017 Mahnke ..... F42B 10/22
2018/0120069 A1 * 5/2018 Kim ..... F42B 10/44
2018/0195844 A1 * 7/2018 Burczynski ..... F42B 10/46

FOREIGN PATENT DOCUMENTS

RU 2406061 C1 12/2010
RU 2410633 C1 1/2011

* cited by examiner

PROJECTILE OF SMALL ARMS AMMUNITION

TECHNICAL FIELD

The invention relates to small arms ammunition and can be used in the designs of projectiles intended for high precision long-range firing at supersonic and subsonic muzzle velocities of a projectile.

PRIOR ART

One way to improve ammunition of small arms, sporting and hunting weapon is to increase ballistic characteristics of projectiles on the trajectory of flight and to decrease dispersion of projectiles that, under otherwise equal conditions, can be achieved by means of reduction of the projectile aerodynamic drag (air resistance) and reduction of the initial disturbance of the projectile as it exits from the barrel.

It is common knowledge that the projectile aerodynamic drag depends on the wave resistance, surface friction drag and vortex (base) drag. Wave resistance depends on the geometry of the projectile head portion and can amount to 60-70% of the total aerodynamic drag at supersonic projectile velocities and 20-30% of the total aerodynamic drag at subsonic projectile velocities (see Description to the Patent RU 2075035 C1, Int. C1.[6] F42B 30/02 of 10, Mar. 1997). That is why the increase of projectile's ballistic characteristics is possible by means of reducing aerodynamic drag of the projectile head portion, which also reduces projectiles dispersion due to the decrease of the trajectory disturbance forces that act upon the projectile, especially under unfavorable firing conditions (dust, fog, rain, snow, etc.).

It is known that at the moment when the projectile exits from the barrel, a circular clearance is formed between the muzzle face of the barrel and the interface interconnecting a cylindrical central leading portion of the projectile and a conical boattail of the projectile. In case of the projectile nutation in the barrel (misalignment of the projectile axis and the bore axis) the circular clearance starts to be formed asymmetrically; moreover, a certain part of the projectile perimeter is separated from the rifling of the barrel bore while the other part of the projectile perimeter is still connected with the rifling of the barrel bore. Gunpowder gas breaks through to this asymmetrical clearance between the barrel bore and the projectile, increasing initial disturbances of the projectile. Besides, at the moment when the projectile exits from the barrel bore, friction and crimp forces acting upon the projectile from the barrel are relieved. If an asymmetrical clearance is formed between the barrel bore and the projectile, the abovementioned forces are relieved asymmetrically thus additionally increasing the projectile initial disturbances.

Initial disturbances not only deflect the projectile trajectory and increase projectiles dispersion but also increase the projectile circular angle of attack (the amplitude of the projectile oscillations) on the trajectory; all this leads to the rise of the projectile aerodynamic drag. That is why, under otherwise equal conditions, an increase in ballistic characteristics of projectiles on the trajectory is possible through a decrease in initial disturbances of the projectile exiting from the barrel.

A projectile of small arms ammunition is known, which comprises a head portion with a blunted nose surface, a cylindrical central leading portion and a boattail, which tapers towards the projectile base (see Description to the Patent RU 2075035 C1, Int. C1.[6] F42B 30/02 of Oct. 3, 1997). The projectile has a smooth transition at the interface interconnecting the cylindrical central leading portion and the boattail, which reduces possible technological mistakes in production of projectiles (manufacturing of the boattail misaligned to the cylindrical central leading portion) and decreases initial disturbances of the projectile as it exits from the barrel. This smooth transition between the central leading portion and the boattail is useful for projectiles with subsonic muzzle velocity that have low velocity of entering the rifling of the barrel bore, and that have a short head portion and a long central portion; all that can minimize the projectile nutation in the barrel.

However, in case of projectile nutation in the barrel, this smooth transition between the cylindrical central leading portion and the boattail cannot prevent formation of an asymmetrical clearance between the projectile and the muzzle face of the barrel and at the same time augments the length of asymmetrical effect of the rifling of the barrel on the boattail thus increasing initial disturbances of the projectile.

A projectile of small arms ammunition is known, which comprises a head portion with a blunted nose surface, a cylindrical central leading portion and a boattail, which tapers towards the projectile base (see Description to the Patent RU 2064159 C1, Int. C1.[6] F42B 30/02 of 22 Mar. 1994). The nose surface is made in the form of a sphere segment. The length of the projectile is equal to 4.4-4.5D, and the length of its head portion is equal to 2.6-2.8D where "D" is the projectile caliber. According to the description of this patent, augmentation of the head portion length from 2.4D (projectile prototype) to 2.6-2.8D increases ballistic characteristics of the projectile on the trajectory of flight.

The description of this patent shows that the lateral surface of the projectile head portion has ogive shape, which is formed by the arc of a circle with a pre-set radius and is tangential to the cylindrical central leading portion. The tangential ogive head portion is known to have a larger volume and a greater aero-ballistic drag than the conical head portion of the same length (see Krasnov, N. F. et. al. Aerodynamics of Rockets. Moscow: Vysshaya Shkola, 1968, P. 45-52, 415-435). This is due to the fact that in the axial longitudinal section of the projectile the actual opening angles of tangents to the lateral surface of the ogive head portion change from 60 degrees to 30 degrees at the front section of the portion, its length being equal to 25-35% of the head portion length. This front section of the projectile head portion produces an increased wave aerodynamic drag at the projectile velocity of more than 0.85 M (280 m/sec).

Moreover, tangential (smooth) mating of the head portion and the cylindrical central leading portion of the projectile forms an increased initial interface between the projectile and the rifling of the barrel bore at the moment when the projectile enters the rifling of the barrel bore. This leads to the enhanced effort of the projectile entering the rifling of the barrel bore, braking of the projectile after leaving the cartridge case and a sharp rise of the gunpowder gas pressure, and as a result to the projectile tilt in the barrel, increase of the projectile nutation in the barrel and of the initial disturbances of the projectile exiting from the barrel.

The closest analog (prototype) of this claimed invention is a small arms projectile, which comprises a head portion with a blunted nose surface, a substantially cylindrical central leading portion and a boattail, which tapers towards the projectile base (see Description to U.S. Pat. No. 4,517,897 Int. C1.[3] F42B 11/08, published on 21 May 1985). The lateral surface of the head portion is optimized in accordance with the Haack equation, has an arc form and smoothly abuts the cylindrical central portion at a tangent to it. The nose surface of the projectile is flat-end shaped. The boattail of the projectile is made as a coupling of two truncated cones, namely a front cone and a rear cone with opening angles equal to 10-20 degrees and 60 degrees respectively, and the length of the boattail equals to 0.5-2.0 $r_0$, the largest diameter of the cylindrical central portion cross-section being D=2 $r_0$.

Analysis of the description and claims of this patent shows that the minimum length ($X_1$) of the head portion for the projectile having a caliber of .223 (5.56 mm) can be 1.9D, and the maximum length ($X_1$) of the head portion for the projectile having a caliber of .50 (12.7 mm) can be 2.9D, the diameter of the interface between the nose surface and the lateral surface of the head portion being within the range of 0.1-0.3D.

Analysis of the geometry of .223 (5.56 mm) projectile presented in the patent description shows that the diameter of the interface between the nose surface and the lateral surface of the head portion is equal to 0.13D, and the length ($X_1$) of the head portion is equal to 1.95D. In the axial longitudinal section of the projectile, the actual opening angles of tangents to the lateral surface of the head portion change from 54 degrees to 30 degrees at the front section, its length being equal to 30% of the head portion length. This front section produces an increased wave aerodynamic drag at the projectile velocity of more than 0.85 M (280 m/sec). Tangential mating of the head portion and the cylindrical central leading portion forms an increased initial interface between the projectile and the rifling of the barrel bore at the moment when the projectile enters into the rifling of the barrel bore. This leads to the enhanced effort of the projectile entering the rifling of the barrel bore, braking of the projectile after leaving the cartridge case and a sharp rise of the gunpowder gas pressure, and as a result to the projectile tilt in the barrel and increase of the projectile nutation in the barrel. In case of the projectile nutation in the barrel the form of the boattail cannot prevent formation of an asymmetrical clearance between the projectile and the muzzle face of the barrel when the projectile exits from the barrel thus increasing initial disturbances and dispersion of the projectiles.

SUMMARY OF THE INVENTION

The purpose of the given invention is to increase the ballistic characteristics of projectiles on the trajectory of flight and to decrease projectiles dispersion.

The mentioned purpose is provided by a projectile of small arms ammunition comprising at least a head portion with a blunted nose surface, a central leading portion and a boattail, which tapers towards the projectile base, wherein the largest diameter of the cross-section of the central leading portion is equal to "D", the length of the head portion is equal to 1.9-2.9D, and the diameter at the interface between the nose surface and the lateral surface of the head portion is equal to 0.15-0.3D, where, pursuant to this invention, the said lateral surface of the head portion is limited by the surface of two adjoining truncated cones, namely a front cone and a rear cone with opening angles equal to 22-30 degrees and 8-16 degrees respectively, and the smaller base of the front truncated cone abuts the nose surface, and the larger base of the rear truncated cone abuts the surface of the central leading portion.

The inventive features specified in the first independent claim allow increasing of the projectile's ballistic characteristics by means of reducing aerodynamic drag (air resistance) of the projectile head portion, which also reduces projectiles dispersion due to the decrease of the trajectory disturbance forces that act upon the projectile. Furthermore, transversal interface between the head portion and the central leading portion reduces the effort of the projectile entering the rifling of the barrel bore thus minimizing projectile nutation in the barrel, decreasing initial disturbances of the projectile exiting from the barrel and projectiles dispersion.

To fulfill the conditions of the given invention, the lateral surface of the head portion should be located inside the surface of two adjoining truncated cones, namely a front cone and a rear cone with opening angles equal to 30 degrees and 8 degrees, and at the same time—outside the surface of two adjoining truncated cones, namely a front cone and a rear cone with opening angles equal to 22 degrees and 16 degrees. Moreover, the lateral surface of the head portion may have any aerodynamic form that is within the above-mentioned limits, and have cylindrical sections and circular grooves as well. In the preferred embodiment the head portion may be made in the form of a combination of two or three truncated cones, which can have smooth transitions at their points of interface. And the base of the rear truncated cone should abut upon the surface of the projectile central leading portion that has a guaranteed interaction with the rifling of the barrel bore at the shot and the cross-section diameter of more than 0.975D.

The increase in the opening angle of the front truncated cone beyond 30 degrees, and of the rear truncated cone beyond 16 degrees provides an increase in aerodynamic drag and a decrease in the ballistic characteristics of a projectile on a trajectory. The decrease in the opening angle of the front truncated cone beyond 22 degrees, and of the rear truncated cone beyond 8 degrees decreases the steadiness of flight and increases projectiles dispersion. Moreover, the decrease in the opening angle of the rear truncated cone beyond 8 degrees leads to the enhanced effort of the projectile entering the rifling of the barrel bore, enhances likelihood of the projectile tilt and the increase of the projectile nutation in the barrel that may result in the projectiles dispersion increase.

In the preferred embodiment of this invention, a step transition between the central leading portion and the boattail is made so that the largest diameter of the cross-section of the boattail is equal to 0.94-0.97D.

This embodiment provides the invention efficiency increase due to the reduction of the initial disturbances of the projectile as it exits from the barrel even in case of increased projectile nutation in the barrel, that also reduces the projectile aerodynamic drag due to the decrease of the projectile circular angle of attack (the amplitude of the projectile oscillations) on a trajectory of flight.

The step transition between the central leading portion and the boattail may be made in the form of a circular groove or a truncated cone. The largest diameter of the boattail cross-section is equal to 0.97D and is smaller than the barrel bore diameter measured at the rifling lands; that is why the boattail of the projectile does not have a guaranteed interaction with the rifling of the barrel bore. The decrease in the largest diameter of the boattail beyond 0.94D worsens the airflow of the boattail and enhances the base drag.

In the embodiment of this invention, blunting of the nose surface is made in the form of a second-degree surface, e.g., a sphere segment or a paraboloid of rotation.

This embodiment provides the invention efficiency increase due to the reduction of the aerodynamic drag of the nose surface.

In the embodiment of this invention, blunting of the nose surface is made in the form of a flat face or a flat face with a rounded edge, a cone or a truncated cone.

This embodiment provides the invention efficiency increase due to the increase in the ballistic characteristics of the projectile at the end of a trajectory and lowering of the probability of the projectile ricochet when impacting a hard obstacle, which can be set at an angle to the line of fire.

In the embodiment of this invention, the rear section of the projectile head portion has a circular groove providing a means for fastening the projectile in a cartridge case.

This embodiment provides the invention efficiency increase due to the increase of the length of the head portion resulting in the aerodynamic drag reduction. The circular groove surface may have the form of a truncated cone with an opening angle equal to 9-18 degrees, measured on the side of the nose surface, thus making it possible to securely fasten the projectile in the cartridge case by crimping the cartridge case neck into said circular groove.

In the embodiment of this invention, the central leading portion of the projectile has one or several circular grooves with the minimum diameter of the cross-section equal to 0.94-0.97D.

This embodiment provides the invention efficiency increase due to the lowering of the projectile friction drag in the barrel and reduction of the projectile material pickup on the rifling of the barrel bore, resulting in the decrease of projectiles dispersion. The increase in the minimum diameter of the circular groove beyond 0.97D enhances likelihood of an asymmetrical contact of the groove surface with the rifling, resulting in the projectiles dispersion increase. The decrease in the diameter of the circular groove beyond 0.94D leads to the increase in the aerodynamic drag of surface friction.

In the embodiment of this invention, a base cavity with the diameter equal to 0.5-0.7D and with the depth equal to 0.5-1.2D is made in the projectile.

This embodiment provides the increase in the projectile ballistic characteristics and decrease in projectiles dispersion due to the weight reduction of the boattail and the shift of the projectile gravity center to the head portion, resulting in the increase in the steadiness of projectiles flight on the trajectory. However, the increase of the base cavity beyond 0.7D reduces the strength of the projectile's wall that may result in the boattail bulge and increase projectiles dispersion. The increase of the base cavity depth beyond 1.2D decreases the projectile weight and ballistic characteristics, and the base cavity having a diameter and depth of less than 0.5D is not efficient.

In the embodiment of this invention, the projectile is made of easy-deformable material with strength parameters corresponding to non-ferrous alloys, such as bronze and brass.

This embodiment provides the invention efficiency increase due to high-precision manufacturing of projectiles from a homogeneous material, resulting in the reduction of likelihood of technological errors at projectiles manufacturing, which can increase projectiles dispersion on the trajectory of flight.

In the embodiment of this invention, the projectile is made from an easy-deformable material with strength parameters corresponding to low-carbon steel or non-ferrous alloys, such as copper, tombac or brass, and has internal filling of a high-density material with density parameters corresponding to alloys based on tungsten or lead.

This embodiment provides the increase in the projectile ballistic characteristics and decrease in projectiles dispersion due to the increase in the projectile weight and/or decrease in the projectile length, resulting in the reduction of the projectile aerodynamic drag, drift and windage.

In the embodiment of this invention, the projectile has a high-strength slug with strength parameters similar to hardened steel or tungsten alloy.

This embodiment provides the invention efficiency increase due to the increase in the ballistic characteristics of the projectile at the end of a trajectory due to the rise of the projectile power of penetrating solid obstacles.

Moreover, the mentioned purpose of the invention, notably, an increase the ballistic characteristics of projectiles on the trajectory of flight and a decrease of projectiles dispersion, is provided by a projectile of small arms ammunition comprising at least a head portion with a blunted nose surface, a central leading portion and a boattail, which tapers towards the projectile base, wherein the largest diameter of the cross-section of the central leading portion is equal to "D", the length of the head portion is equal to 1.9-2.9D, and the diameter at the interface between the nose surface and the lateral surface of the head portion is equal to 0.15-0.3D, where, pursuant to this invention, a step transition between the central leading portion and the boattail is made so that the largest diameter of the cross-section of the boattail is equal to 0.94-0.97D.

The inventive features specified in the second independent claim allow the increase in projectiles ballistic characteristics and decrease in the dispersion of projectiles with any shape of the head portion due to the reduction of initial disturbances of the projectile exiting from the barrel, even in case of the projectile nutation in the barrel that also reduces aerodynamic drag by means of decreasing the projectile circular angle of attack (the amplitude of the projectile oscillations) on the trajectory of flight.

A step transition between the central leading portion and the boattail may be made in the form of a circular groove or a truncated cone with an opening angle equal to 40-150 degrees, measured at the base of the projectile, thus providing practically instantaneous separation of the whole perimeter of the central leading portion from the rifling of the barrel bore as the projectile exits from the barrel. The largest diameter of the boattail cross-section is equal to 0.97D and is guaranteed to be smaller than the barrel bore diameter, measured at the rifling lands; that is why the boattail of the projectile does not interact with the rifling of the barrel bore. The increase in the largest diameter of the boattail beyond 0.97D increases initial disturbances of the projectile in case of the projectile nutation in the barrel. The decrease in the largest diameter of the boattail beyond 0.94D worsens the airflow of the boattail and enhances the base drag.

Moreover, in accordance with the second independent claim the projectile may have any aerodynamic shape and comprise all above-said design parameters, which provide the invention efficiency increase.

The stated design parameters of the projectile were calculated and then verified experimentally when firing with 223 (5.56×45 mm) and .308 (7.62×51 mm) ammunition at supersonic and subsonic muzzle velocities of projectiles in different embodiments of the invention.

BRIEF DESCRIPTION OF THE DRAWINGS

The invention is explained in more detail with the reference to specific embodiments that in no way reduce the volume of claims and are only intended for better understanding of the invention by one of skill in the art.

In the description of specific embodiments of the invention there are references to the accompanying drawings that show the following.

DESCRIPTION OF THE PREFERRED EMBODIMENT

Figure 1:
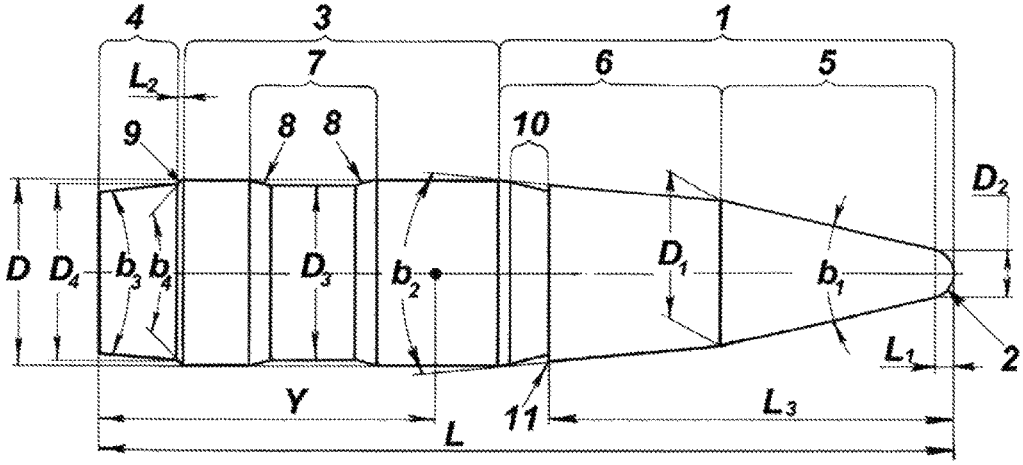
FIG. 1 shows the first example of the invention embodiment in a projectile of .223 (5.56×45 mm) ammunition.

FIG. 1 shows design of a projectile of .223 (5.56×45 mm) ammunition. The projectile comprises a head portion 1 with a blunted nose surface 2, a substantially cylindrical central leading portion 3 and a boattail 4, which tapers towards the projectile base. The largest diameter of the cross-section of the central leading portion 3 is D=5.69 mm, the projectile length is L=4.6D (26.2 mm) and the length of the head portion 1 is equal to 2.4D.

The lateral surface of the head portion 1 is limited by the surface of two truncated cones, namely a front cone 5 and a rear cone 6 with opening angles $b_1$=26 degrees and $b_2$=12 degrees, having the diameter at the interface $D_1$=0.76D. The nose surface 2 is made in the form of a sphere segment having the radius R=0.6 mm with a tangential interface having the diameter $D_2$=0.205D (1.17 mm) with the upper base of the front truncated cone 5, wherein the height of the nose surface is $L_1$=0.082D (0.465 mm).

Such form of the head portion 1 provides a decrease in aerodynamic drag in comparison with the prototype of the invention. Transversal interface between the lateral surface of the rear truncated cone 6 and cylindrical surface of the central leading portion 3 forms a small pitch surface of the projectile contact with the rifling of the barrel bore at the moment when the projectile enters the rifling, resulting in a decrease in the effort of the projectile entering the rifling of the barrel bore and likelihood of the projectile nutation in the barrel.

The central leading portion 3 has the length of 1.74D and is supplied with a circular groove 7 having the length of 0.72D, diameter $D_3$=0.97D and smooth transitions 8 to the cylindrical surface with the diameter "D". The length of the central leading portion 3 equal to 1.74D ensures steadiness of the projectile in the rifling of the barrel bore, and a circular groove 7 having the length of 0.72D decreases the projectile friction force in the barrel, thus providing for the increase in the gunpowder charge weight even without overpressure of the shot, hence, for the increase in the muzzle velocity and initial ballistic parameters of the projectile. Herewith smooth transitions 8 help to eliminate imbalance of the airflow around the central leading portion 3 that results in the reduction of the aerodynamic drag of the surface friction.

The boattail 4 has the length of 0.45D and is made in the form of a truncated cone with the opening angle $b_3$=10 degrees. A step transition 9 between the central leading portion 3 and the boattail 4 is made in the form of a truncated cone with the opening angle $b_4$=110 degrees, wherein the largest diameter of the cross-section of the boattail $D_4$=0.97D (5.52 mm) and is smaller than the diameter of the barrel bore (5.56 mm), measured at the rifling lands. That is why the boattail 4 does not interact with the rifling of the barrel bore. Short length of the step transition $L_2$=0.01D provides a symmetrical separation of the whole projectile perimeter from the rifling of the barrel bore and decreases initial disturbances of the projectile from the barrel even at the increased nutation of the projectile in the barrel. Herewith, the surface of the central leading portion 3 with a formed rifling profile has a partially smooth interface with the boattail surface 4 without any increase in the base drag in comparison with the prototype and analogs of the invention. It is worth mentioning that the rifling of the barrel bore always worsens approximately half of the profile of smooth interface interconnecting the central leading portion and boattail of the known projectiles. That is why any known projectile exiting from the barrel has a similar smooth interface between the central leading portion and boattail. In this invention, the rifling of the barrel bore helps to smooth the step transition 9 and ensures smooth interface of approximately half of the profile of the central leading portion and boattail.

In the rear part 6 of the head portion 1 there is a circular groove 10 having the form of a truncated cone and designed to fasten the projectile in ammunition by crimping the neck of the cartridge case into the circular groove 10. Such geometry of the head portion 1 provides a decreased aerodynamic drag, as the total length of the head portion 1 is larger than the length of the projectile $L_3$, which is beyond the bounds of the cartridge case. Herewith, stall of the ram air from the edge 11 reduces aerodynamic drag of the surface friction of the central leading portion 3, on which a rifling profile is formed as the projectile exits from the barrel.

Figure 2:
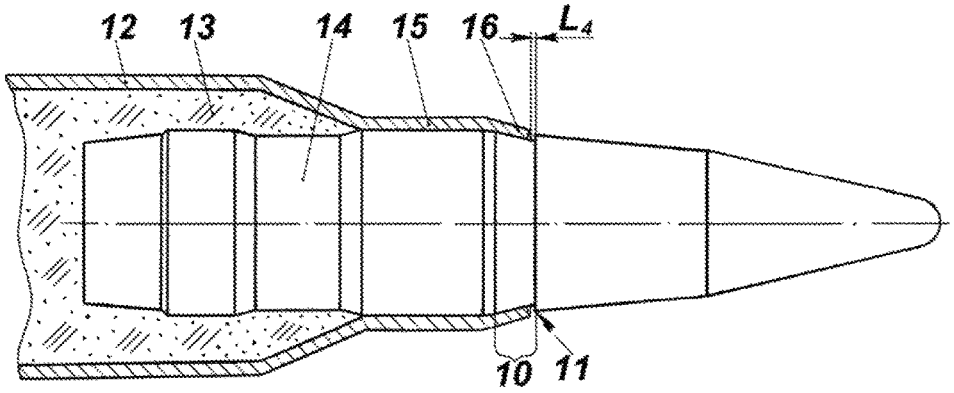
FIG. 2 shows the first example of the invention embodiment in the projectile, which is fastened in .223 (5.56×45 mm) ammunition.

FIG. 2 shows the longitudinal section of a fragment of .223 (5.56×45 mm) ammunition with the fastened projectile shown in FIG. 1.

Ammunition comprises a cartridge case 12 with a primer cap, gunpowder charge 13 and a projectile 14, which is pressed into the neck 15 of the cartridge case 12 up to the edge 11 of the groove 10. The front section 16 of the neck 15 is crimped into the circular groove 10 and keeps the projectile 14 from possible falling out of the cartridge case 12 and the edge 11 of the circular groove 10 keeps the projectile 14 from possible falling into the cartridge case 12. Herewith, technological clearance $L_4$=0.05-0.25 mm between the edge 11 of the circular groove 10 and the neck end 15 is preferred to be filled with a sealant to preserve the gunpowder charge parameters 13. At a shot, the conical surface of the circular groove 10 smoothly straightens the crimped front section 16 of the neck 15, thus ensuring a stable projectile exit from the cartridge case 12.

Up-to-date engineering facilities provide for high-precision and high-productive manufacturing of projectiles from easy-deformable material such as bronze and brass. The projectile, shown in FIG. 1 and FIG. 2, is made completely of brass with the density of 8.35-8.39 g/cm$^3$ and has the weight of 4.0 g. The projectile center of gravity is located at a distance of Y=1.79D (10.18 mm) from the projectile base, and the relation between the projectile's longitudinal and cross-sectional moments of inertia is $I_{YY}/I_{XX}$=11.19. These parameters ensure a stable flight of said projectile when firing from a standard barrel of .223 (5.56 mm) caliber with the barrel twist equal to 178 mm (7 inches).

When firing with .223 (5.56×45 mm) ammunition with the given brass projectile (FIG. 1) weighing 4.0 g and with the known "SS109" (M855) projectile weighing 4.0 g from a ballistic barrel 510 mm long, it was determined that muzzle velocity of brass projectiles is equal to 955-967 m/sec, and muzzle velocity of "SS109" projectiles is equal to 932-945 m/sec. Moreover, the crusher pressure, measured at a distance of 47 mm from the head of the cartridge case, equals to 4,700-5,000 bar in ammunition with the brass projectile and to 5,100-5,400 bar in ammunition with the "SS109" projectile.

The increase in muzzle velocity of the given brass projectile at the decrease in the pressure compared with the "SS109" projectile can be explained by the geometry of the head portion 1, which provides the increase in the cartridge case volume before the projectile starts entering the rifling of the barrel bore, resulting in the reduction of the density of loading and possible increase of the gunpowder charge weight without raising the allowable pressure. Herewith, transversal interface between the head portion 1 and the central leading portion 3 lowers the effort of the projectile entering the rifling of the barrel bore, and a circular groove 7 reduces the projectile friction force in the barrel.

When firing from a "Heckler & Koch SL8-1" sporting rifle fixed in a bench, it was defined that at the same muzzle velocity of 942-950 m/sec the diameter of dispersion of the given brass projectiles (FIG. 1) does not exceed 2.8 cm at 100 m range and 9.0 cm at 300 m range, and the diameter of dispersion of "SS109" projectiles does not exceed 4.8 cm at 100 m range and 16.0 cm at 300 m range. Herewith, it was defined that the velocity of brass projectiles is 857-866 m/sec at 100 m range and 694-708 m/sec at 300 m range, and the velocity of "SS109" projectiles is 832-844 m/sec at 100 m range and 638-650 m/sec at 300 m range.

These tests have shown that at similar initial conditions of firing at 300 m range the velocity of the given brass projectiles is by 5.5% higher and the dispersion is by 77% lower than the velocity and dispersion of the "SS109" projectiles. All that confirms that selection of the projectile design parameters of the given invention was correct.

Moreover, to confirm correctness of selecting the projectile design parameters (FIG. 1), special samples of projectiles were made, which differed from the projectile shown on FIG. 1 only by the lack of the step transition 9. In these projectiles the central leading portion 3 has a smooth interface with the boattail 4 made in the form of a truncated cone with an opening angle $b_3$=10 degrees.

Comparative tests of projectile samples without the step transition 9 have shown that at 100 m range and 300 m range the dispersion of projectiles without the step transition 9 is by 30-40% higher than the dispersion of projectiles (FIG. 1), but by 30-40% lower than the dispersion of the "SS109" projectiles. Herewith, at 100 m range and 300 m range the velocity of projectiles without the step transition 9 was by 1.5-2.5% lower than the velocity of the given projectiles (FIG. 1), but by 3.0-4.0% higher, than the velocity of the "SS109" projectile at the same range. These tests have shown that the head portion of the projectile, limited by the surface of two truncated cones, increases ballistic characteristics on the flight trajectory due to the decrease in the projectile aerodynamic drag and also decreases dispersion of projectiles due to the reduction of trajectory disturbances affecting the projectile. Moreover, these tests have shown that elimination of the projectile initial disturbances as a result of the step transition 9 not only reduces projectiles dispersion, but also increases ballistic characteristics of the projectile on the trajectory.

Table 1 lists comparative characteristics of .223 (5.56×45 mm) ammunition with the projectile of the given invention (FIG. 1), ammunition with the known projectile "SS-109" and a prototype of this invention. Specifications of the known projectile "SS109" (M855) represented at the Website: http://www.ak-47.net/ammo/ss109.txt have been metricated. Specifications of the prototype are in accordance with the description of the U.S. Pat. No. 4,517,897, published on May 21, 1985. Design characteristics of the projectile of the proposed invention (FIG. 1) were calculated at muzzle velocity of 945 m/sec, initial angle of attack $\alpha_0$=0.5 degrees and initial velocity of changing the angle of attack $\omega_0$=0.5 radian/sec.

Table 1 shows that velocities of the "SS109" projectile and calculated velocities of the projectile (FIG. 1) differ from the experimental data by no more than 2%. Moreover, the given brass projectile ensures the increase of ballistic characteristics in comparison with the prototype and the projectile "SS109" (M855). At a 500 m range, the energy of the brass projectile is by 15% higher and the flight time is by 7% less compared with the prototype of this invention. These facts confirm that the limitation of the head portion surface by the surface of two truncated cones 5 and 6 makes provision for the aerodynamic drag reduction. Further reduction of aerodynamic drag is possible if the nose surface 2 is made in the form of a cone, truncated cone or paraboloid of rotation having the height $L_1$=0.2-0.4D and the interface diameter $D_2$=0.2-0.3D with the upper base of the front truncated cone 5.

Increase of the projectile's ballistic characteristics is possible by means of increasing the projectile weight at a certain decrease of muzzle velocity. When made of bronze with the density of 8.81 g/cm$^3$, the given projectile (FIG. 1) has the weight of 4.20 g and better ballistic characteristics than the brass projectile. Moreover, the projectile may comprise a slug made of lead or tungsten alloy, which increases the projectile weight. Improvement of the projectile ballistic characteristics at the end of a trajectory is possible by means of increasing the projectile penetrating power provided for by fitting it with a hard slug made of hardened steel or tungsten alloy.

Figure 3:
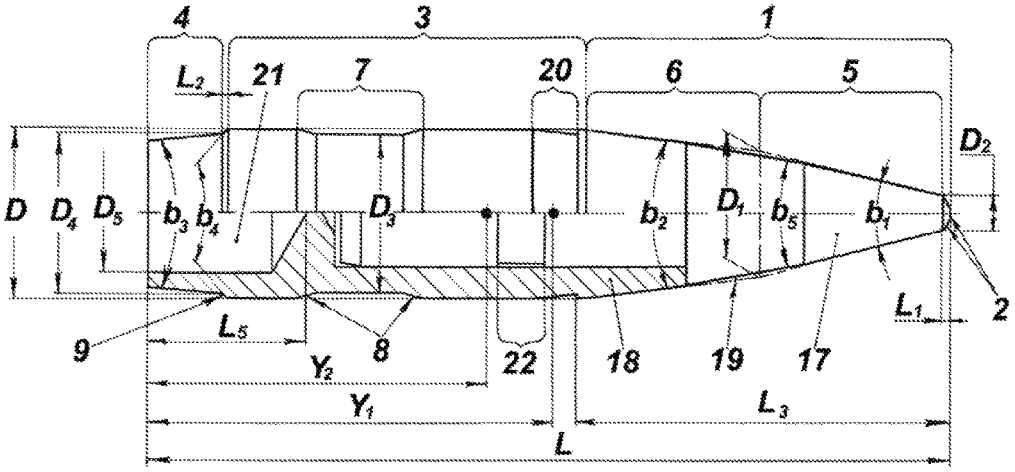
FIG. 3 shows the second example of the invention embodiment in a projectile of .223 (5.56×45 mm) ammunition.

FIG. 3 shows a longitudinal section of the design of a projectile of .223 (5.56×45 mm) ammunition, which comprises a slug 17 and a jacket 18.

The projectile comprises a head portion 1 with a blunted nose surface 2, a substantially cylindrical central leading portion 3 and a boattail 4, which tapers towards the projectile base. The largest diameter of the cross-section of the central leading portion is D=5.69 mm, the projectile length is L=4.78D (27.2 mm) and the length of the head portion 1 is equal to 2.15D.

The lateral surface of the head portion 1 is limited by the surface of two truncated cones, namely a front cone 5 and a rear cone 6 with opening angles $b_1$=26 degrees and $b_2$=14 degrees, having the diameter at the interface $D_1$=0.78D. The conical surface 19 of the slug 17 has an opening angle $b_5$=15 degrees and does not go beyond the limits of the lateral surface of the head portion but provides smooth interface between outer surfaces of the slug 17 and the jacket 18, which have different strength at tandem machining by different tools on up-to-date equipment. The nose surface 2 is made in the form of a truncated cone and has a tangential interface with the diameter $D_2$=0.21D with the upper base of the front truncated cone 5, wherein the height of the nose surface is $L_1$=0.04D. Such nose surface 2 improves ballistic characteristics of the projectile at the end of a trajectory due to lowering of the probability of the projectile ricochet when impacting a solid obstacle.

The central leading portion 3 has the length of 2.12D and is supplied with a circular groove 7 having the length of 0.88D, diameter $D_3$=0.97D and smooth transitions 8 to the cylindrical surface with the diameter "D". In the front part of the central leading portion 3 there is a circular groove 20, having the form of a truncated cone and designed to fasten a projectile in ammunition by crimping the front section of the cartridge case neck into the circular groove 20. The way of fastening the projectile in ammunition is similar to FIG. 2, the total length of the head portion 1 being less than the length of the projectile $L_3$, which is beyond the bounds of the cartridge case.

The boattail 4 has the length of 0.49D and is made in the form of a truncated cone with the opening angle $b_3$=9 degrees. A step transition 9 between the central leading portion 3 and the boattail 4 is made in the form of a truncated cone with the opening angle $b_4$=70 degrees and height $L_2$=0.02D. Herewith, the largest diameter of the boattail is $D_4$=0.97D (5.52 mm) and is smaller than the diameter of the barrel bore (5.56 mm), measured at the rifling lands, that is why the boattail 4 does not interact with the rifling of the barrel bore.

The projectile has a base cavity 21 with the diameter $D_5$=0.67D and depth $L_5$=0.72D. This base cavity 21 shifts the projectile center of gravity ($Y_1$ or $Y_2$) to the head portion 1 and increases the projectile stability at a trajectory, especially if the slug 17 is made of steel with the density of 7.81-7.85 g/cm$^3$, which is lower than the density of brass. The jacket 18 of the projectile is made of brass with the density of 8.35-8.39 g/cm$^3$.

When projectiles are manufactured on CNC-machines, the slug 17 is pressed into the jacket 18, and outer surfaces of the slug and the jacket undergo tandem machining, a projectile is cut from a long-length brass rod and a base cavity 21 is made. Such technology guarantees strict adherence to the outside dimensions of the projectile and smooth interface between the outer surfaces of the slug and the jacket, resulting in the increase of the projectile ballistic characteristics. The slug 17 has a circular groove 22, which is filled with the jacket material at the interaction with the rifling of the barrel bore, thus reducing the effort of the projectile entering the rifling of the barrel bore, decreases the likelihood of the projectile nutation in the barrel and also decreases initial disturbances of the projectile as it exits from the barrel.

In the embodiment where the slug 17 is made of tungsten alloy with the density of 16.8-17.2 g/cm$^3$, the projectile weight is equal to 5.55 g, its center of gravity is located at the distance of $Y_1$=2.26D (12.86 mm) from the projectile base, the relation between the projectile's longitudinal and cross-sectional moments of inertia is $I_{YY}/I_{XX}$=12.29. In the embodiment where the slug 17 is made of steel with the density of 7.81-7.85 g/cm$^3$, the projectile weight is equal to 3.70 g, its center of gravity is located at the distance of $Y_2$=1.98D (11.28 mm) from the projectile base, the relation between the projectile's longitudinal and cross-sectional moments of inertia is $I_{YY}/I_{XX}$=10.29. These parameters ensure a stable flight of said projectiles when firing from a standard barrel of .223 (5.56 mm) caliber with the barrel twist equal to 178 mm (7 inches).

When firing with .223 (5.56×45 mm) ammunition with the given projectiles (FIG. 3) from a ballistic barrel 510 mm long, it was determined that muzzle velocity of projectiles having the weight of 5.55 g is equal to 843-855 m/sec, and muzzle velocity of projectiles having the weight of 3.70 g is equal to 968-980 m/sec. Moreover, the crusher pressure, measured at a distance of 47 mm from the cartridge case base equals to 4,600-4,900 bar in both variants of ammunition.

When firing with .223 (5.56×45 mm) ammunition with the given projectiles (FIG. 3) from a "Heckler & Koch SL8-1" sporting rifle fixed in a bench, it was defined that the dispersion diameter of projectiles having the weight of 5.55 g does not exceed 2.2 cm at 100 m range and 7.0 cm at 300 m range, and the dispersion diameter of projectiles having the weight of 3.70 g does not exceed 3.1 cm at 100 m range and 10.0 cm at 300 m range. Herewith, the velocity of projectiles having the weight of 5.55 g equals to 778-786 m/sec at 100 m range and 652-664 m/sec at 300 m range, and the velocity of projectiles having the weight of 3.70 g equals to 868-876 m/sec at 100 m range and 690-700 m/sec at 300 m range. Moreover, it was determined that projectiles having the weight of 5.55 g penetrate a 10 mm steel plate at 300 m range, and projectiles having the weight of 3.70 g penetrate this 10 mm steel plate at 100 m range, but only 50% of "SS109" projectiles can penetrate this 10 mm steel plate at 50 m range.

Table 2 lists characteristics of .223 (5.56×45 mm) ammunition with the projectile of the given invention (FIG. 3) having the weight of 5.55 g and 3.70 g, which were calculated at the projectile initial angle of attack $\alpha_0$=0.5 degrees and initial velocity of changing the angle of attack $\omega_0$=0.5 radian/sec.

Table 2 shows that calculated velocities of the projectile (FIG. 3) differ from the experimental data by no more than 2%. It follows from Table 2 that the given projectile even with the reduced weight of 3.70 g ensures the increase of ballistic characteristics in comparison with the prototype at "E" and "T" parameters and significantly outweighs all characteristic features of the "SS109" (M855) projectile having the weight of 4.0 g (see Table 1). The increase in the weight of the given projectile up to 5.55 g results in a considerable improvement of the projectile ballistic characteristics on a trajectory and reduction of projectiles dispersion.

Figure 4:
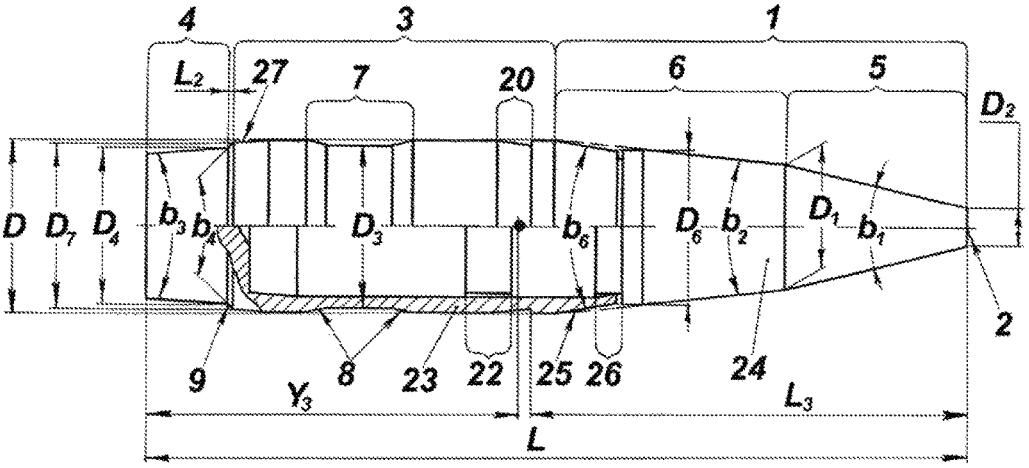
FIG. 4 shows third example of the invention embodiment in a projectile of .308 (7.62×51 mm) ammunition.

FIG. 4 shows a longitudinal section of the design of a projectile of .308 (7.62×51 mm) ammunition, which comprises a jacket 23 and a slug 24.

The projectile comprises a head portion 1 with a blunted nose surface 2, a substantially cylindrical central leading portion 3 and a boattail 4, which tapers towards the projectile base. The largest diameter of the cross-section of the central leading portion 3 is D=7.81 mm, the projectile length is L=4.80D (37.5 mm) and the length of the head portion 1 is equal to 2.42D.

The lateral surface of the head portion 1 is limited by the surface of two truncated cones, namely a front cone 5 and a rear cone 6 with opening angles $b_1$=28 degrees and $b_2$=11 degrees, having the diameter at the interface $D_1$=0.74D. The surface 25 of the jacket 23 has an opening angle $b_5$=12 degrees and does not go beyond the limits of the lateral surface of the head portion 1 but provides smooth transition between the surfaces 25 with the outer surface of the slug on the diameter $D_6$=0.94D during the projectile assembly by crimping a part of the surface 25 into a circular groove 26 of the slug 24. The nose surface 2 is made in the form of a flat face having the diameter $D_2$=0.2D that improves ballistic characteristics of the projectile at the end of a trajectory due to the lowering of likelihood of the projectile ricochet when impacting a solid obstacle.

The central leading portion 3 has the length of 1.92D and is supplied with a circular groove 7 having the length of 0.65D, the minimum diameter $D_3$=0.97D and smooth transitions 8 to the cylindrical surface with the diameter "D". In the front part of the central leading portion 3 there is a circular groove 20, having a form of a truncated cone and designed to fasten a projectile in ammunition by crimping the front section of the cartridge case neck into the circular groove 20. The way of fastening the projectile in ammunition is similar to FIG. 2, the total length of the head portion 1 being less than the length of the projectile $L_3$, which is beyond the bounds of the cartridge case. In the rear part of the leading portion 3 there is a smooth narrowing 27 to the diameter $D_7$=0.99D (7.73 mm), which interacts with the rifling of the barrel bore but is exposed to a weaker crimping force from the barrel bore that results in the reduction of initial disturbances of the projectile exiting from the barrel.

The boattail 4 has the length of 0.45D and is made in the form of a truncated cone with the opening angle $b_3$=10 degrees. A step transition 9 between the central leading portion 3 and the boattail 4 is made in the form of a truncated cone with the opening angle $b_4$=90 degrees and height $L_2$=0.01D. Herewith, the largest diameter of the boattail $D_4$=0.97D (7.57 mm) is smaller than the diameter of the barrel bore (7.62 mm), measured at the rifling lands, that is why the boattail 4 does not interact with the rifling of the barrel bore.

The jacket 23 is made of brass with the density of 8.35-8.39 g/cm$^3$. The slug 24 is made of tungsten alloy with the density of 16.8-17.2 g/cm$^3$ and has a circular groove 22, which is filled with the jacket 23 material at the interaction with the rifling of the barrel bore, thus reducing the effort of the projectile entering the rifling of the barrel bore, decreases the likelihood of the projectile nutation in the barrel and initial disturbances of the projectile as it exits from the barrel. The weight of the projectile is equal to 19.60 g, its center of gravity is located at the distance of $Y_3$=2.10D (16.39 mm) from the projectile base, the relation between the projectile's longitudinal and cross-sectional moments of inertia is $I_{YY}/I_{XX}$=13.05. These parameters ensure a stable flight of the given projectile up to the distance of over 1,200 m when firing with a supersonic muzzle velocity and up to the distance of 600 m when firing with a subsonic muzzle velocity from a standard barrel of .308 (7.62×51 mm) caliber with the barrel twist equal to 305 mm (12 inches).

When firing with .308 (7.62×51 mm) ammunition with the given projectile (FIG. 4) from a ballistic barrel 560 mm long, it was determined that muzzle velocity of the projectile is equal to 625-634 m/sec at crusher pressure equal to 3,500-3,650 bar. When firing with a subsonic muzzle velocity of the projectile equal to 320-330 m/sec, crusher pressure does not exceed 1,400 bar.

When firing with .308 (7.62×51 mm) ammunition with the given projectile (FIG. 4) from a "Remington-Model 700" sporting rifle fixed in a bench, it was defined that at a supersonic muzzle velocity equal to 624-633 m/sec the dispersion diameter of projectiles does not exceed 1.6 cm at 100 m range and 5.2 cm at 300 m range. Herewith, the velocity of projectiles equals to 594-600 m/sec at 100 m range and 528-540 m/sec at 300 m range. At a subsonic muzzle velocity of 323-328 m/sec the dispersion diameter of projectiles does not exceed 2.6 cm at 100 m range and 8.6 cm at 300 m range, herewith, projectiles velocity is equal to 314-319 m/sec at 100 m range and to 293-302 m/sec at 300 m range. Moreover, it was determined that when firing with a subsonic muzzle velocity given projectiles (FIG. 4) penetrate a 8 mm steel plate at 300 m range.

These tests have shown that the design of projectiles in the given invention can be successfully used not only when firing with a supersonic muzzle velocity but also when firing with a subsonic muzzle velocity. Insignificant increase in projectiles dispersion at firing with a subsonic muzzle velocity compared to firing with a supersonic muzzle velocity can be explained by a low velocity of the projectile exiting from the barrel, when the period while barrel vibration disturbances and disturbances of gunpowder gases exhausting from the barrel affect the projectile increases 2-3 times. Nevertheless, when firing with a subsonic muzzle velocity, the step transition 9 between the central leading portion 3 and the boattail 4 of the projectile provided a two-fold reduction of dispersion of the given projectiles (FIG. 4) compared to the projectiles "SS109", which have a supersonic muzzle velocity.

Table 3 lists characteristics of .308 (7.62×51 mm) ammunition with the projectile of the given invention (FIG. 4) having the weight of 19.60 g, which were calculated at muzzle velocities of 630 m/sec and 325 m/sec, initial angle of attack $\alpha_0$=0.5 degrees and initial velocity of changing the angle of attack $\omega_0$=0.5 radian/sec.

Table 3 shows that calculated velocities of the projectile (FIG. 4) differ from the experimental data by no more than 2%. Conducted tests and calculations prove that the head portion limited by the surface of two truncated cones reduces aerodynamic drag; and the step transition between the central leading portion and the boattail can decrease initial disturbances of the projectile discharged from the barrel with subsonic and supersonic muzzle velocities thus providing the improvement of the projectile ballistic characteristics on a trajectory and reduction of projectiles dispersion.

INDUSTRIAL APPLICABILITY

The invention can be applied in the design of new projectiles and in the upgrading of standard 5.45-14.5 mm projectiles, intended for high precision firing with supersonic and subsonic muzzle velocity of a projectile.

Creation of new 5.45-14.5 mm projectiles with a head portion limited by the surface of two truncated cones can increase ballistic characteristics of the projectile on the trajectory of flight due to the reduction of aerodynamic drag of the projectile head portion and also decrease projectiles dispersion due to the reduction of trajectory disturbance forces affecting the projectile. Herewith, the transversal interface between the head and central leading portions minimizes the projectile nutation in the barrel thus decreasing initial disturbances of the projectile discharged from the barrel and reduces projectiles dispersion.

Modernization of standard 5.45-14.5 mm projectiles by way of making a step transition between the central leading portion and boattail of the projectile can provide the increase of its ballistic characteristics on the trajectory of flight and reduce projectiles dispersion due to the decrease of the projectile initial disturbances.

Moreover, these projectiles can have a traditional design including a jacket of brass or of tombac and a slug of lead or of steel in aluminum or lead alloy. Besides, projectiles may be made completely of brass or bronze and also have an inner filling of high-density material with density parameters corresponding to the parameters of alloys based on tungsten.

TABLE 1

Comparative characteristics of .223 (5.56 × 45 mm) ammunition with the known "SS109" (M855) projectile, a prototype of this invention and the projectile FIG. 1 of the given invention

| Range of projectile | Designation and projectile weight | | | | | | | | |
|---|---|---|---|---|---|---|---|---|---|
| | "SS109" (M855) Projectile weight is 4.0 g | | | U.S. Pat. No. 4,517,897 (prototype) Projectile weight - ? | | Projectile FIG. 1 of the given invention Projectile weight is 4.0 g | | | |
| trajectory | Velocity (V), energy (E), flight time (T) and height of trajectory (Y) | | | | | | | | |
| X m | V m/sec | E Joule | Y m | E Joule | T sec | V m/sec | E Joule | T sec | Y m |
| 0 | 945 | 1786 | 0 | — | — | 945 | 1786 | 0 | 0 |
| 100 | 838 | 1404 | +0.11 | — | — | 860 | 1479 | 0.11 | +0.12 |
| 200 | 737 | 1086 | +0.15 | — | — | 778 | 1210 | 0.23 | +0.12 |
| 300 | 645 | 832 | 0 | 879 | 0.39 | 700 | 980 | 0.37 | 0 |
| 400 | 558 | 623 | −0.38 | — | — | 623 | 776 | 0.52 | −0.29 |
| 500 | 478 | 457 | −1.09 | 525 | 0.74 | 550 | 605 | 0.69 | −0.81 |
| 600 | 403 | 325 | −2.24 | — | — | 480 | 461 | 0.88 | −1.65 |
| 700 | 337 | 227 | −3.96 | — | — | 415 | 344 | 1.11 | −2.91 |
| 800 | 307 | 188 | −6.80 | — | — | 358 | 256 | 1.37 | −4.73 |

TABLE 2

Characteristic of .223 (5.56 × 45 mm) ammunition with the projectile FIG. 3

| Range of projectile | Projectile weight is 5.55 g | | | | Projectile weight is 3.70 g | | | |
|---|---|---|---|---|---|---|---|---|
| trajectory | Velocity (V), energy (E) flight time (T) and height of trajectory (Y) | | | | | | | |
| X m | V m/sec | E Joule | T sec | Y m | V m/sec | E Joule | T sec | Y m |
| 0 | 850 | 2005 | 0 | 0 | 970 | 1740 | 0 | 0 |
| 100 | 784 | 1705 | 0.12 | +0.17 | 875 | 1416 | 0.11 | +0.13 |
| 200 | 720 | 1438 | 0.26 | +0.18 | 784 | 1137 | 0.23 | +0.14 |
| 300 | 658 | 1201 | 0.40 | 0 | 697 | 899 | 0.36 | 0 |
| 400 | 598 | 992 | 0.56 | −0.40 | 613 | 695 | 0.52 | −0.34 |
| 500 | 541 | 812 | 0.74 | −1.08 | 534 | 528 | 0.69 | −0.93 |
| 600 | 487 | 658 | 0.93 | −2.09 | 459 | 390 | 0.90 | −1.87 |
| 700 | 436 | 527 | 1.15 | −3.52 | 392 | 284 | 1.13 | −3.28 |
| 800 | 389 | 420 | 1.39 | −5.47 | 337 | 210 | 1.41 | −5.32 |
| 900 | 350 | 340 | 1.66 | −8.06 | 308 | 175 | 1.72 | −8.20 |
| 1000 | 321 | 286 | 1.96 | −11.44 | 288 | 153 | 2.06 | −12.08 |
| 1100 | 305 | 258 | 2.28 | −15.85 | 270 | 135 | 2.42 | −17.12 |
| 1200 | 291 | 235 | 2.62 | −21.08 | 254 | 119 | 2.80 | −23.47 |

TABLE 3

Characteristic of .308 (7.62 × 51 mm) ammunition with the projectile FIG. 4
Projectile weight is 19.60 g
Range of projectile trajectory (X), velocity (V), energy (E), flight time (T) and height of trajectory (Y)

| Supersonic muzzle velocity of projectile | | | | | Subsonic muzzle velocity of projectile | | | | |
|---|---|---|---|---|---|---|---|---|---|
| X m | V m/sec | E Joule | T sec | Y m | X m | V m/sec | E Joule | T sec | Y m |
| 0 | 630 | 3890 | 0 | 0 | 0 | 325 | 1035 | 0 | 0 |
| 100 | 598 | 3505 | 0.16 | +0.29 | 50 | 320 | 1003 | 0.16 | +0.37 |
| 200 | 566 | 3139 | 0.33 | +0.30 | 100 | 315 | 972 | 0.31 | +0.49 |
| 300 | 536 | 2815 | 0.52 | 0 | 150 | 311 | 948 | 0.47 | +0.37 |
| 400 | 506 | 2509 | 0.71 | −0.64 | 200 | 307 | 924 | 0.63 | 0 |
| 500 | 477 | 2230 | 0.91 | −1.66 | 250 | 303 | 612 | 0.80 | −0.63 |

TABLE 3-continued

Characteristic of .308 (7.62 × 51 mm) ammunition with the projectile FIG. 4
Projectile weight is 19.60 g
Range of projectile trajectory (X), velocity (V), energy (E), flight time (T) and height of trajectory (Y)

| Supersonic muzzle velocity of projectile | | | | | Subsonic muzzle velocity of projectile | | | | |
|---|---|---|---|---|---|---|---|---|---|
| X m | V m/sec | E Joule | T sec | Y m | X m | V m/sec | E Joule | T sec | Y m |
| 600 | 449 | 1976 | 1.13 | −3.11 | 300 | 299 | 876 | 0.97 | −1.54 |
| 700 | 422 | 1745 | 1.36 | −5.05 | 350 | 295 | 853 | 1.13 | −2.71 |
| 800 | 397 | 1544 | 1.60 | −7.54 | 400 | 291 | 830 | 1.30 | −4.17 |
| 900 | 373 | 1363 | 1.86 | −10.65 | 450 | 288 | 813 | 1.48 | −5.92 |
| 1000 | 352 | 1214 | 2.14 | −14.47 | 500 | 284 | 790 | 1.65 | −7.97 |
| 1100 | 334 | 1093 | 2.43 | −19.07 | 550 | 281 | 774 | 1.83 | −10.31 |
| 1200 | 322 | 1016 | 2.74 | −24.55 | 600 | 277 | 752 | 2.01 | −12.97 |

The invention claimed is:

1. A projectile of small arms ammunition comprising at least a head portion with a blunted nose surface, a central leading portion, and a boattail, which tapers towards the projectile base, wherein the largest diameter of the cross-section of the central leading portion is equal to "D", the length of the head portion is equal to 1.9-2.9D, and the diameter at the interface between the nose surface and the lateral surface of the head portion is equal to 0.15-0.3D, wherein the said lateral surface of the head portion is limited by the surface of two adjoining truncated cones, namely a front cone and a rear cone with opening angles equal to 22-30 degrees and 8-16 degrees respectively, and the smaller base of the front truncated cone abuts the nose surface, and the larger base of the rear truncated cone abuts the surface of the central leading portion.

2. The projectile in accordance with claim 1, wherein between the central leading portion and the boattail a step transition is made so that the largest diameter of the cross-section of the boattail is equal to 0.94-0.97D.

3. The projectile in accordance with claim 1, wherein the blunted nose surface is made in the form chosen from the group including: a cone or a truncated cone; a flat face or a flat face with a rounded edge; a second-degree surface, e.g., a sphere segment or a paraboloid of rotation.

4. The projectile in accordance with claim 1, wherein the rear cone of the head portion has a circular groove, providing a possibility of fastening the projectile in cartridge case.

5. The projectile in accordance with claim 1, wherein the central leading portion has one or several circular grooves with the minimum diameter of the cross-section equal to 0.94-0.97D.

6. The projectile in accordance with claim 1, wherein a base cavity with the diameter equal to 0.5-0.7D and with the depth equal to 0.5-1.2D is made in the projectile.

7. The projectile in accordance with claim 1, wherein it is made of easy-deformable material with strength parameters corresponding to non-ferrous alloys, such as bronze and brass.

8. The projectile in accordance with claim 1, wherein it is made of an easy-deformable material with strength parameters corresponding to low-carbon steel or non-ferrous alloys, such as copper, tombac or brass, and has internal filling of a high-density material with density parameters corresponding to alloys based on tungsten or lead.

9. The projectile in accordance with claim 1, wherein it has a high-strength slug with strength parameters similar to hardened steel or tungsten alloy.

10. A projectile of small arms ammunition comprising at least a head portion with a blunted nose surface, a central leading portion, and a boattail, which tapers towards the projectile base, moreover, the largest diameter of the cross-section of the central leading portion is equal to "D", the length of the head portion is equal to 1.9-2.9D, and the diameter at the interface between the nose surface and the lateral surface of the head portion is equal to 0.15-0.3D, wherein between the said central leading portion and the boattail a step transition is made so that the largest diameter of the cross-section of the boattail is equal to 0.94-0.97D.

11. The projectile in accordance with claim 10, wherein the lateral surface of the head portion is limited by the surface of two adjoining truncated cones, namely a front cone and a rear cone with opening angles equal to 22-30 degrees and 8-16 degrees respectively, and the smaller base of the front truncated cone abuts the nose surface, and the larger base of the rear truncated cone abuts the surface of the central leading portion.

12. The projectile in accordance with claim 10, wherein the blunted nose surface is made in the form chosen from the group including: a cone or a truncated cone; a flat face or a flat face with a rounded edge; a second-degree surface, e.g., a sphere segment or a paraboloid of rotation.

13. The projectile in accordance with claim 10, wherein the rear cone of the head portion has a circular groove, providing a possibility of fastening the projectile in cartridge case.

14. The projectile in accordance with claim 10, wherein the central leading portion has one or several circular grooves with the minimum diameter of the cross-section equal to 0.94-0.97D.

15. The projectile in accordance with claim 10, wherein a base cavity with the diameter equal to 0.5-0.7D and with the depth equal to 0.5-1.2D is made in the projectile.

16. The projectile in accordance with claim 10, wherein it is made of easy-deformable material with strength parameters corresponding to non-ferrous alloys, such as bronze and brass.

17. The projectile in accordance with claim 10, wherein it is made of an easy-deformable material with strength parameters corresponding to low-carbon steel or non-ferrous alloys, such as copper, tombac or brass, and has internal filling of a high-density material with density parameters corresponding to alloys based on tungsten or lead.

18. The projectile in accordance with claim 10, wherein it has a high-strength slug with strength parameters similar to hardened steel or tungsten alloy.

* * * * *